United States Patent [19]

Yates et al.

[11] Patent Number: 4,533,627

[45] Date of Patent: Aug. 6, 1985

[54] PROCESS FOR THE PREPARATION OF A SILVER HALIDE EMULSION

[75] Inventors: Andrew W. Yates, Knutsford; Brian D. Harradine, Macclesfield; Michael A. Wraith, Stretford, all of England

[73] Assignee: Ciba-Geigy AG, Basel, Switzerland

[21] Appl. No.: 515,311

[22] Filed: Jul. 18, 1983

[30] Foreign Application Priority Data

Jul. 23, 1982 [GB] United Kingdom ..... 8221359

[51] Int. Cl.[3] ..... G03C 1/02

[52] U.S. Cl. ..... 430/567; 430/569

[58] Field of Search ..... 430/569, 571, 567

[56] References Cited

U.S. PATENT DOCUMENTS

| | | | |
|---|---|---|---|
| 3,326,641 | 6/1967 | Audran et al. | 430/569 |
| 3,773,516 | 11/1973 | Gutoff | 430/569 |
| 4,334,012 | 6/1982 | Mignot | 430/569 |
| 4,336,328 | 6/1982 | Brown et al. | 430/569 |
| 4,446,228 | 5/1984 | Honda et al. | 430/567 |

FOREIGN PATENT DOCUMENTS 63962 11/1982 European Pat. Off. .

1335925 10/1973 United Kingdom .

OTHER PUBLICATIONS

Research Disclosure, Sep. 1976, No. 14987, pp. 95–96.

*Primary Examiner*—Mary F. Downey

*Attorney, Agent, or Firm*—Joseph G. Kolodny

[57] ABSTRACT

Process for the preparation of silver halide emulsions containing populations of monodispersed silver halide crystals, which comprises transferring an amount of monodispersed silver halide crystals from a reaction vessel to a holding vessel, effecting growth of the silver halide crystals remaining in the reaction vessel, transferring the monodispersed silver halide crystals thus obtained to a further holding vessel followed by another growth step of the silver halide crystals left in the reaction vessel, combining all the populations of monodispersed silver halide crystals of different crystal size, and carrying out the steps required to produce a fully sensitized and concentrated silver halide emulsion.

These emulsions when used in photographic materials exhibit a reduced contrast and a relatively high sensitivity.

6 Claims, No Drawings

PROCESS FOR THE PREPARATION OF A SILVER HALIDE EMULSION

This invention relates to a process for the preparation of a photographic silver halide emulsion.

Methods for the preparation of monodispersed silver halide emulsions have been described for example in GB No. 1,335,925 which are well suited to the preparation of medium to high contrast emulsions with very good reproducibility. However, for certain applications where it is necessary to produce a film or print material with low contrast, i.e. high sensitivity range, it is difficult to make use of the benefits of monodispersed emulsions while at the same time producing a wide range of sizes of silver halide crystals necessary for a low contrast photographic emulsion. One method is to produce two or more monodispersed emulsions with differing crystal size medians as separate entities and to blend these in suitable proportions prior to the coating operation. However, it has been found that this procedure has two important drawbacks. First, the final contrast or sensitivity range obtained is dependent not only on the final crystal size range obtained, but also any differences in degree of chemical sensitisation introduced due to lack of control between the two or more concentration, digestion and stabilisation processes performed on the component emulsions. Second, any system of blending after emulsion preparation is likely to involve a greater total number of emulsions prepared as well as necessitating additional manual handling and emulsion stock management.

It is therefore an object of the present invention to provide a process for the preparation of a silver halide emulsion comprising a mixture of monodispersed silver halide crystal populations, which process minimises the above mentioned disadvantages.

According to the present invention, there is provided a process for the preparation of a silver halide emulsion which comprises preparing a population of monodispersed silver halide crystals dispersed in an aqueous hydrophilic colloid medium in a reaction vessel, the process being characterised in that a predetermined volume of the medium containing the monodispersed silver halide crystals is transferred to a holding vessel and then a growth step is carried out on the silver halide crystals remaining in the reaction vessel, which comprises effecting increased growth of these crystals to produce a population of monodispersed silver halide crystals of increased size, optionally effecting at least one further transfer to a holding vessel of a volume of the medium containing the silver halide crystals in the reaction vessel followed by another growth step of the silver halide crystals left in the reaction vessel, combining all the populations of monodispersed silver halide crystals of different mean crystal size, and then carrying out the steps required to produce a fully sensitized and concentrated silver halide emulsion.

The steps required to produce a fully sensitized and concentrated silver halide emulsion may include for example:

Coagulation of the emulsion by treating it with an aqueous acid and a salt, such as sodium sulphate, or treating it with a concentrated solution of a wetting agent, redispersing the coagulated emulsion in an aqueous colloid medium to yield an emulsion which is of the desired concentration, chemical sensitization of the emulsion by means of a sulphur sensitizer, a reduction sensitizer or a noble metal sensitizer for example, to increase the photographic sensitivity of the silver halide crystals, stabilization of the emulsion to stop chemical sensitization at a required degree of sensitization and to prevent the emulsion being fogged, and optical or spectral sensitization of the emulsion by addition of optical or spectral sensitizers.

It is important, however, that no physical or Ostwald ripening of the emulsion takes place. This means that the crystals should not increase in size after all the crystal growth stages have been effected.

It is further important that no excess water soluble halides are present in the silver halide dispersions, which are transferred to the holding vessels since, as mentioned above, no further growth of the crystal sizes of the transferred crystals should take place.

Preferably, in the process of the present invention, controlled growth conditions are used to prepare the populations of monodispersed silver halide crystals. Such a controlled growth process is described for example in GB No. 1,335,925.

According to this reference, an aqueous solution of a silver salt and an aqueous solution of an alkali metal or ammonium halide are added to an aqueous dispersing medium containing a protective colloid at such a concentration that silver halide crystals are nucleated. The silver halide crystals are caused to increase in size by adding to the aqueous dispersing medium, an aqueous silver salt solution and an aqueous alkali metal or ammonium halide solution, while controlling conditions in the aqueous dispersing medium to ensure that the supersaturation level of silver halide in solution in the liquid phase of the dispersing medium is greater than X times the supersaturation level of silver halide in solution, at which nucleation under these conditions occurs. X at any one time during the growth stage is given by the formula $$X=(r_1)^2/(r_2)^2,$$

where $r_1$ is the size of the crystals immediately at the end of nucleation, and $r_2$ is the mean linear size of the crystals.

Other objects of the present invention are the silver halide emulsions obtained by the process according to the invention and a photographic material comprising in at least one layer said silver halide emulsions.

Preferably, the hydrophilic colloid used in the process of the present invention is gelatin. Conveniently, the concentration vessel can be used as the sole holding vessel to which the volume or volumes of medium containing the dispersed silver halide crystals are transferred from the reaction vessel. Preferably, the reaction vessel comprises stirring means to keep the silver halide crystals present therein or being formed therein in an even dispersion throughout the volume of the aqueous medium.

Preferably, stirring means are present in the concentration vessel to ensure an even distribution of the silver halide crystals of different mean size throughout the volume of the final emulsion.

Preferably, the reaction vessel and the holding vessel(s) and/or concentration vessel are all temperature controlled to keep the aqueous media present therein at a constant temperature between 20° and 80° C., and most preferably between 40° and 70° C. Most preferably, the aqueous medium in all the vessels is kept at the same controlled temperature.

It is to be understood that more aqueous hydrophilic colloid solution and/or water may be added to the remaining dispersion of silver halide crystals in the reaction vessel after each transfer of a part of the volume therein to a holding vessel. This is to ensure that the remaining volume contains enough hydrophilic colloid to form a dispersion of the enlarged silver halide crystals in the subsequent growth step and to ensure that there is sufficient volume of medium to carry out effective stirring.

Also more aqueous hydrophilic colloid solution and/or water may be added to any of the holding vessels at any stage in the process, if so required.

Thus, according to a preferred method of the present invention there is provided a process for the preparation of a silver halide emulsion, which comprises preparing a dispersion of monodispersed microcrystals of predetermined size in an aqueous hydrophilic colloid medium, carrying out a growth step by adding a predetermined volume of this dispersion to a temperature controlled reaction vessel equipped with stirring means, adding further water and aqeuous hydrophilic colloid solution to a predetermined volume, adding simultaneously to the reaction vessel streams or jets of an aqueous silver salt solution and/or an aqueous ammonium or alkali metal halide (or mixture of halides) solution of known concentration, these additions being carried out at a steadily increasing rate until a predetermined volume of each of the two solutions has been added such that at this stage in the process there is substantially no excess water soluble halide present in the aqueous medium, the process being characterised in that a predetermined volume of the medium containing a dispersion of monodispersed silver halide crystals, of increased size compared with the microcrystals is transferred to a holding vessel, where this volume is held at a controlled temperature, diluting optionally the remaining medium in the reaction vessel by adding water and/or aqueous hydrophilic colloid solution, carrying out a further growth step by adding simultaneously to the reaction vessel streams or jets of an aqueous silver salt solution and of an aqueous ammonium or alkali metal halide (or a mixture of halides) solution of known concentration, these additions being carried out at a steadily increasing rate until a predetermined volume of each of the two solutions has been added such that at this stage in the process there is substantially no excess water soluble halide present, then optionally effecting at least one further transfer of a predetermined volume of the medium in the reaction vessel to a holding vessel followed by a further growth step, combining all the portions of aqueous hydrophilic colloid media containing dispersions of silver halide crystals of differing mean size, and then carrying out the steps mentioned above to produce a fully sensitized and concentrated silver halide emulsion.

In this aspect of the invention as well, the preferred hydrophilic colloid is gelatin. As before, the preferred temperature range at which to keep the reaction vessel and the holding vessel(s) is 20° to 80° C. and most preferably between 40° and 70° C.

In this aspect of the invention as well, most preferably all the transferred aqueous medium is transferred to a concentration vessel which acts as a holding vessel.

In this aspect of the invention, it is important to determine the size of the microcrystals before commencing the growth steps. As this is a time consuming and difficult operation usually a large batch of microcrystals is prepared at one time and the mean particle size determined. A portion of such a batch is then used in the process of the present invention. A suitable crystal size range for the microcrystals is 0.05 to 1.0 μm.

Microcrystals used in the process of the present invention are sometimes referred to as seed crystals. They may also be prepared as described in the above mentioned GB No. 1,335,925.

The silver halide emulsion prepared by the process of the present invention comprises a dispersion of at least two monodispersed emulsions of different mean size. However, it may contain a mixture of three of four monodispersed emulsions, but it rarely contains more than four. Most commonly, it would be a mixture of three monodispersed emulsions. These emulsions may be present in any proportion. A suitable range of crystal sizes for the three components is:

small crystals: 0.10 to 0.60 μm
medium crystals: 0.15 to 0.90 μm
large crystals: 0.20 to 1.50 μm Most usually very many more, in number, small crystals are required in the emulsions than medium or large crystals. A typical ratio is 100 small:10 medium:1 large.

The chemical sensitization step carried out in the process of the present invention is carried out at the pH, pAg, temperature conditions and intervals of time as commonly employed in sensitizing photographic silver halide emulsions. They may be sensitized with a sulphur sensitizer, a reduction sensitizer or a noble metal sensitizer or a mixture of these sensitizers.

The emulsion is thereafter stabilised in the normal manner by the addition of a stabilizing compound. This addition stops and stabilizes the chemical sensitization and also helps to stabilize the emulsion against incubation fog. Any of the stabilizers known in the art may be used for example tetrazaindene compounds or benzimidazole compounds.

The emulsion prepared by the process of the present invention may be sensitized with an optical or spectral sensitizing dye, such as a methine dye or other dyes. Examples of the dyes to be employed include cyanine dyes, merocyanine dyes, complex cyanine dyes, complex merocyanine dyes, hemicyanine dyes, styryl dyes and hemioxonol dyes. Particularly useful dyes are those belonging to metal complexes of merocyanine dyes.

The following Example will serve to illustrate the invention.

EXAMPLE

A seed emulsion was prepared by double jetting equal quantities of aqueous solutions of silver nitrate (4.7M) and 70/30 sodium chloride/sodium bromide (4.7M) into a gelatin solution under conditions of controlled silver ion concentration to give a substantially monodispersed population of crystals with 0.12 μm median crystal edge length.

A suitable proportion of this seed emulsion was diluted with gelatin solution and the crystals grown to increased size by further additions of the above silver nitrate and sodium halide solutions, the rates of additions being increased according to the method of GB No. 1,335,925 to maintain the substantial monodispersity of the emulsion. During growth, the emulsion was kept at 40° C. under well stirred conditions at constant silver ion concentration. When sufficient silver nitrate and sodium halide had been added for the median crystal edge length to reach 0.20 μm, a proportion of the emulsion was transferred to a holding vessel. The remaining emulsion was subjected to further growth under the same conditions to yield an emulsion of 0.30 μm median crystal edge length. The two emulsions were combined in the holding vessel. The quantity of initial seed emulsion taken and the proportion transferred at the stage of partial growth were calculated, so that the combined emulsion contained equal quantities, with respect to weight of silver halide, of the two component populations of crystals.

The combined or blended emulsion was coagulated by acidification with acetic acid and addition of sodium sulphate. After washing the coagulated emulsion was redispersed in 15% aqueous gelatin solution and chemically sensitized with a sulphur sensitizer. After stabilization the emulsion was coated together with a wetting agent and hardening agent on a polyethylene laminated base. This coating, designated 'A' was exposed and processed in a developer of the following formula:

| | |
|---|---|
| water | 500 ml |
| potassium sulphite (65% w/v soln.) | 240 ml |
| potassium carbonate (anh) | 100 g |
| hydroquinone | 35.0 g |
| 1-phenyl-3-pyrazolidone | 1.0 g |
| sodium hydroxide | 11.0 g |
| potassium bromide | 7.0 g |
| anti-foggant | 0.10 g |
| diethylenetriamine penta-acetic acid (37% w/v soln) | 25.0 ml |
| water to | 1 l |

The pH value of this developer composition when 1 part is diluted with 9 parts of water is 10.80±0.05.

As reference controls for this example three further coatings were prepared:

'B': from separately prepared emulsions with crystal edge lengths 0.20 μm and 0.30 μm, respectively, made according to the same procedure as used for 'A' but combined in the same ratio immediately prior to the coating operation.

'C': from the emulsion component of 'B' with 0.20 μm crystal edge length.

'D': from the emulsion component of 'B' with 0.30 μm crystal edge length.

All four coatings contained 1.1 g/m$^2$ silver. They were exposed and processed as described for coating 'A'.

The sensitivity and contrast of the four coatings was as follows:

| Coating | relative logarithm of the sensitivity at density 0.7 | contrast |
|---|---|---|
| 'A' (invention) | 2.37 | 1.65 |
| 'B' | 2.16 | 1.65 |
| 'C' | 1.94 | 2.40 |
| 'D' | 2.40 | 2.30 |

Thus, substantially reduced contrast was achieved with both coatings 'A' and 'B' as compared with the unblended emulsion 'C' and 'D'. However, not only does 'A' represent a more efficient procedure for production, it also, in this example, achieves higher sensitivity than that given by coating 'B'.

What is claimed is:

1. A process for the preparation of a silver halide emulsion, which comprises (1) preparing a seed emulsion containing a substantially monodispersed population of silver halide crystals in a reaction vessel, (2) growing said seed emulsion by increasing the addition of silver and halide salts at such a rate as to maintain the substantial monodispersity of the silver halide crystals (3) transferring a predetermined volume of the medium containing said monodispersed silver halide crystals to a holding vessel, where no physical ripening occurs, (4) carrying out a further growth on the silver halide crystals remaining in the reaction vessel, which comprises effecting increased growth of said crystals under the same conditions as defined in step (2) to produce a population of monodispersed silver halide crystals on increased size, (5) combining the populations of monodispersed silver halide crystals of different means size, and then (6) carrying out the steps required to produce a fully sensitized and concentrated silver halide emulsion.

2. A process according to claim 1, wherein the reaction vessel and the holding vessel(s) are all temperature controlled to keep the aqueous media present therein at a constant temperature between 20° and 80° C.

3. A process according to claim 1, wherein in the first step a dispersion of monodispersed silver halide microcrystals of predetermined size in an aqueous hydrophilic colloid medium is formed.

4. A process according to claim 3, which comprises preparing a dispersion of monodispersed microcrystals of predetermined size in an aqueous hydrophilic colloid medium, carrying out a growth step by adding a predetermined volume of this dispersion to a temperature controlled reaction vessel equipped with stirring means, adding further water and an aqueous hydrophilic colloid solution to a predetermined volume, adding simultaneously to the reaction vessel streams or jets of an aqueous silver salt solution and of an aqueous ammonium or alkali metal halide or mixture of such halides solution of known concentration, these additions being carried out at a steadily increasing rate until a predetermined volume of each of the two solutions has been added such that at this stage in the process there is substantially no excess water soluble halide present in the aqueous medium, the process being characterised in that a predetermined volume of the medium containing the monodispersed silver halide crystals of increased size is transferred to a holding vessel, where this volume is held at a controlled temperature, diluting, optionally, the remaining medium in the reaction vessel by adding water and/or an aqueous hydrophilic colloid solution, carrying out a further growth step by adding simultaneously to the reaction vessel streams or jets of known concentration of an aqueous silver salt solution and of an aqueous ammonium or alkali metal halide or a mixture of halides solution, these additions being carried out at a steadily increasing rate until a predetermined volume of each of the two solutions has been added such that at this stage in the process there is substantially no excess water soluble halide present, then optionally effecting at least one further transfer of a predetermined volume of the medium in the reaction vessel to another holding vessel followed by a further growth step, combining all the portions of aqueous hydrophilic colloid media containing dispersions of silver halide crystals of differing mean size, and then carrying out the steps, to produce a fully sensitized and concentrated silver halide emulsion.

5. A process according to claim 1, wherein the monodispersed silver halide crystals have a minimum size of 0,05 μm and a maximum size of 1.5 μm.

6. A process according to claim 1, wherein at least one further transfer to a holding vessel of a volume of a medium containing the silver halide crystals in the reaction vessel is effected followed by another growth step of the silver halide crystals left in the reaction vessel.

* * * * *